US005249026A

United States Patent [19]

Kojima

[11] Patent Number: 5,249,026

[45] Date of Patent: Sep. 28, 1993

[54] IMAGE FORMING SYSTEM AND PROCESS CARTRIDGE MOUNTABLE ON SAME

[75] Inventor: Hisayoshi Kojima, Yokohama, Japan

[73] Assignee: Canon Kabushiki Kaisha, Tokyo, Japan

[21] Appl. No.: 882,307

[22] Filed: May 13, 1992

[30] Foreign Application Priority Data

May 17, 1991 [JP] Japan ..... 3-140798

[51] Int. Cl.[5] ..... G03G 15/01; G03G 15/08

[52] U.S. Cl. ..... 355/327; 355/260

[58] Field of Search ..... 355/327, 245, 260, 210, 355/211

[56] References Cited

U.S. PATENT DOCUMENTS

| | | | |
|---|---|---|---|
| 4,866,482 | 9/1989 | Hirasawa et al. | 355/245 X |
| 4,924,267 | 5/1990 | Yoshikawa et al. | 355/245 X |
| 4,994,853 | 2/1991 | Fukuchi et al. | 355/327 X |
| 4,996,566 | 2/1991 | Morita et al. | 355/246 |
| 4,999,676 | 3/1991 | Mouri | 355/246 |
| 5,036,367 | 7/1991 | Haneda et al. | 355/327 X |
| 5,051,778 | 9/1991 | Watanabe et al. | 355/210 X |
| 5,063,409 | 11/1991 | Nukajima | 355/200 |
| 5,065,195 | 11/1991 | Haneda et al. | 355/326 X |
| 5,073,795 | 12/1991 | Nukaya | 355/210 |
| 5,079,593 | 1/1992 | Satoh et al. | 355/210 X |
| 5,083,158 | 1/1992 | Kashima et al. | 355/210 |

FOREIGN PATENT DOCUMENTS

| | | | |
|---|---|---|---|
| 0320921 | 6/1989 | European Pat. Off. . | |
| 0407183 | 1/1991 | European Pat. Off. . | |
| 2-118673 | 5/1990 | Japan | 355/327 |
| 3-206474 | 9/1991 | Japan | 355/327 |
| 3-293337 | 12/1991 | Japan | 355/327 |

OTHER PUBLICATIONS

Patent Abstracts of Japan, vol. 10, No. 169, Jun. 14, 1986, for Japanese Document 61-20961, published Jan. 29, 1986.

Patent Abstracts of Japan, vol. 14, No. 372, Aug. 10, 1990, for Japanese Document 2-137867, published May 28, 1990.

Patent Abstracts of japan, vol. 14, No. 415, Sep. 7, 1990, for Japanese Document 2-160262, published Jun. 20, 1990.

Abstract of German Offenlegungsschrift DE 4003695, published Aug. 23, 1990.

*Primary Examiner*—R. L. Moses

*Attorney, Agent, or Firm*—Fitzpatrick, Cella, Harper & Scinto

[57] ABSTRACT

The present invention relates to an image forming system and a process cartridge mountable thereon. A developing device can be separated into a first portion including a developing roller and a second portion including a toner containing member, and the second portion can be removably mounted on the cartridge. Thereby, it is possible to utilize the toner containing containers effectively without repeating the positioning of the developing roller with respect to a photosensitive member.

32 Claims, 11 Drawing Sheets

IMAGE FORMING SYSTEM AND PROCESS CARTRIDGE MOUNTABLE ON SAME

BACKGROUND OF THE INVENTION

1. Field of the Invention

The present invention relates to a process cartridge integrally including at least an image bearing member and developing means, and an image forming system within which such process cartridge can be removably mounted. The image forming system may be a copying machine, facsimile, printer and the like.

2. Related Background Art

Conventionally, process cartridges integrally including a photosensitive member, a charger, developing means and the like as a unit, which can be removably mounted within an image forming system, have been widely used in order to improve the maintenance of the image forming system. However, various members or elements (for example, a charger wire, photosensitive drum, developing roller, toner and the like) used in such a process cartridge have different service lives. Thus, by adopting the exchange of a process cartridge, maintenance has been improved.

On the other hand, it is considered that the whole developing device including a toner containing portion can be removable with respect to the process cartridge so that the toner can be replenished frequently, in view of the replenishment of the toner having the least service life among the elements used in the process cartridge. However, this method is not economical since the whole developing device, including not only the toner containing portion but also a developing roller having a service life which has not yet been expired, must be exchanged. Further, since the developing roller must be positioned with respect to the photosensitive drum whenever the developing device is exchanged, the operability is remarkably worsened.

SUMMARY OF THE INVENTION

An object of the present invention is to provide a process cartridge and an image forming system within which such process cartridge can be removably mounted, which can effectively utilize the service lives of various elements and is economical.

Another object of the present invention is to provide a process cartridge and an image forming system within which such process cartridge can be removably mounted, which can improve the operability of each of developing devices.

The other objects of the present invention will be apparent from the following descriptions.

DETAILED DESCRIPTION OF THE PREFERRED EMBODIMENTS

The present invention will now be explained in connection with embodiments thereof with reference to the accompanying drawings. Incidentally, as an example of a process cartridge, a process cartridge having at least an image forming member and a plurality of developing devices will be described herein.

Figure 1:
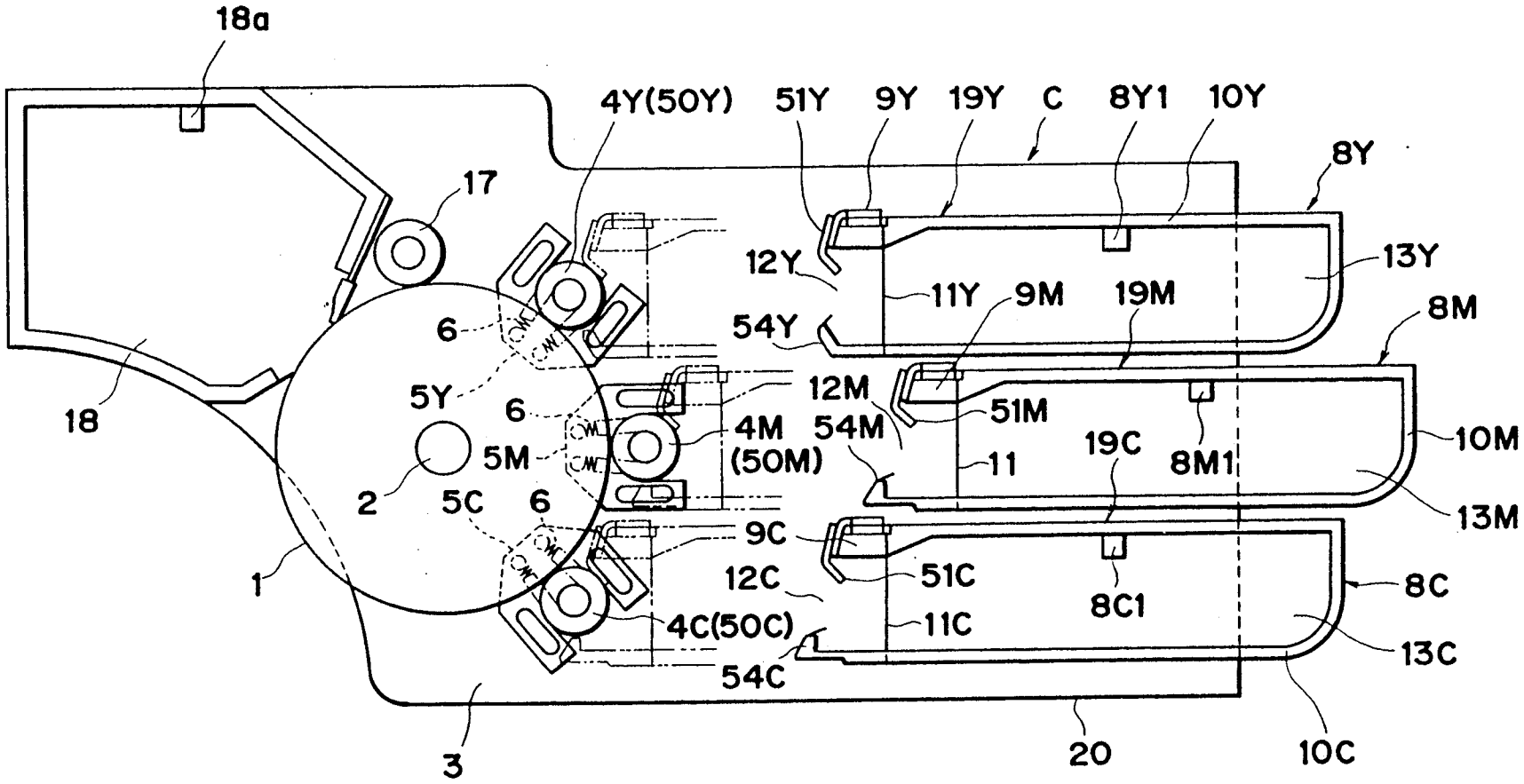
FIG. 1 is an elevational sectional view of a process cartridge according to a first embodiment of the present invention.
Figure 8:
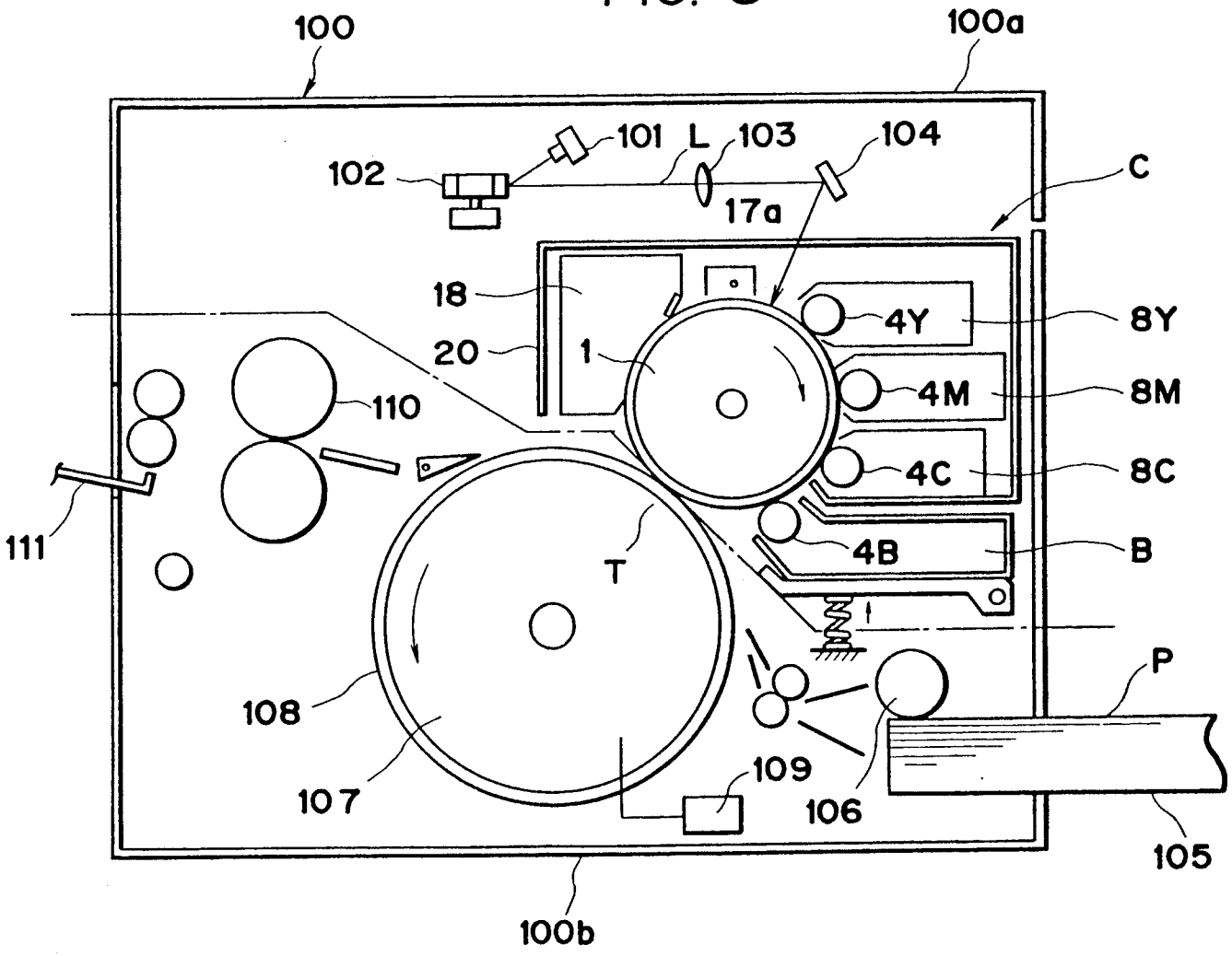
FIG. 8 is an elevational sectional view of an image forming system according to an embodiment of the present invention in a condition that the image formation is permissible.
Figure 9:
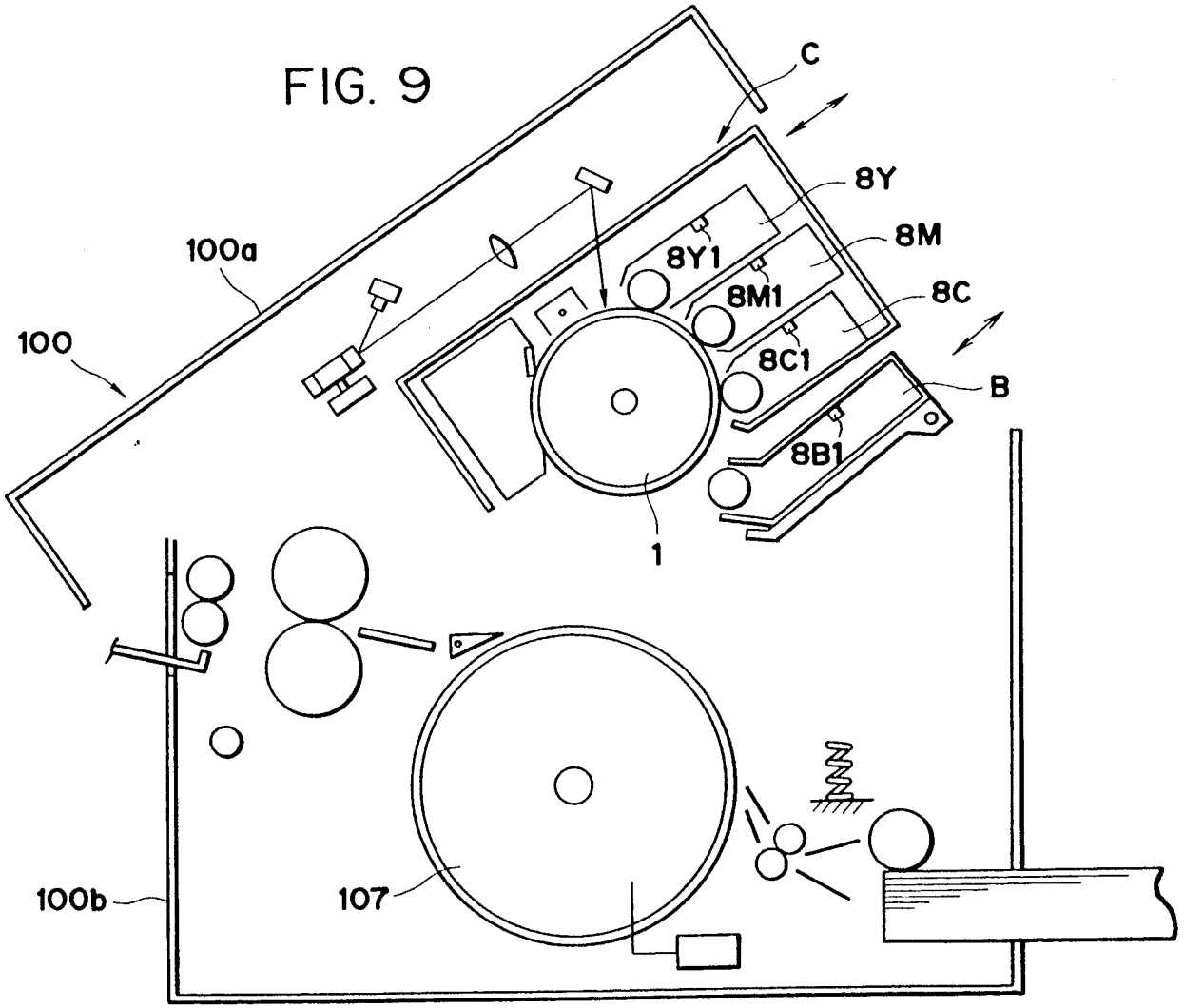
FIG. 9 is an elevational sectional view of the image forming system according to the embodiment of the present invention in a condition that a process cartridge can be mounted or dismounted.

FIG. 1 is an elevational sectional view of a color cartridge C. The cartridge C includes a housing into which a photosensitive drum (image bearing member) 1, a primary charger 17, a cleaning device 18 and a plurality of developing devices 8Y, 8M, 8C are integrally incorporated. The cartridge C is removably mountable within a color image forming system as shown in FIGS. 8 and 9. Incidentally, the photosensitive drum 1 is rotatably supported by side walls 3 of the cartridge via a drum shaft 2 and can be rotatingly driven by a drive source (not shown) of the image forming system.

Now, the image forming operation effected by the image forming system according to the illustrated embodiment will be explained with reference to FIGS. 8 and 9. Incidentally, FIG. 8 is a view showing a condition that the color cartridge C and a black developing unit B are mounted within the image forming system 100 for obtaining the image formation permissible state. FIG. 9 is a view showing a condition where an upper housing 100*a*, of the image forming system 100, is opened with respect to a lower housing 100*b* so that the cartridge C and the black developing unit B can be dismounted independently from the image forming system.

In FIGS. 8 and 9, the photosensitive drum 1, in the C, is uniformly charged by a corona charger 17*a* with a voltage of about −600 V while being rotated in a direction shown by the arrow.

Next, when an electric signal corresponding to the yellow component is sent to a laser diode 101, the latter emits a light beam L, modulated in response to the electric signal, to a rotating polygonal mirror 102 by which the light beam L is reflected to reach a reflection mirror 104 through a lens 103. The light beam L is then reflected by the mirror 104 to illuminate the photosensitive drum 1, thereby forming an electrostatic latent image corresponding to the image signal on the photosensitive drum. Incidentally, in this case, energy of the illuminating light is so selected to charge the illuminated surface of the photosensitive drum 1 with −60 V.

The electrostatic latent image formed on the photosensitive drum 1 is developed by the color developing device 8Y. That is to say, a so-called inversion development is effected by applying a voltage having the same potential and polarity (for example, −500 V) as the charging polarity of the photosensitive drum 1 to a toner supplying roller 4Y, to adhere yellow toner to the illuminated area of the photosensitive drum 1. Incidentally, the voltage to be applied may be obtained by overlapping the AC voltage of several kilovolts to the DC voltage of −500 V, if necessary.

Although the developing method may be a conventional two-component magnetic brush developing method, Cascade developing method, Touch-down developing method, Jamping developing method, Cloud developing method or the like, in any case, when the development is effected by the color developing device 8Y, it is necessary to stop the developing operations of the other developing devices 8M, 8C and B. To achieve this, there have been adopted various methods, such as a method for separating the developing devices 8M, 8C, B from the photosensitive drum, a method for applying the adequate opposite bias voltages to toner supplying rollers of the developing devices 8M, 8C, B, a method for stopping the toner supplying rollers of the developing devices 8M, 8C, B and the like. Incidentally, any combination of such methods may be adopted to stop the developing operations of the developing devices 8M, 8C, B.

On the other hand, a recording sheet P is supplied from a recording sheet cassette 105 by a sheet supply roller 106 and is wound around a transfer rotary member 107. Accordingly, a peripheral length of the transfer rotary member 107 is so selected to be greater than a length of the recording sheet P. If necessary, the transfer rotary member 107 may be provided with a gripper means or an air suction means to hold a leading end of the recording sheet P on the rotary member, or may be provided with a sheet 108 having thereon an insulation layer such as a Myler sheet, to form an electrostatic attracting roller for electrostatically attracting the recording sheet onto rotary member.

In, in the illustrated embodiment, the photosensitive drum 1 and the transfer rotary member 107 are arranged in parallel with each other along their longitudinal directions and are urged against each other by an appropriate means (not shown) to constitute a transfer station T.

The voltage of +1∼5 KV having the polarity opposite to that of the toner is applied to the transfer rotary member 107 from an external power source 109. When the recording sheet P has a width of 210 mm and a weight of 80 g/m$^2$, by selecting the transfer current to 1∼1.5 μA, the yellow toner is transferred onto the recording sheet P wound around the transfer rotary member 107 at the transfer station T, thereby forming an yellow visual image. Incidentally, after the transferring operation, the toner remaining on the photosensitive drum 1 is removed by a cleaning device 18 having cleaning means such as a blade, a fur brush or a magnet brush.

Then, the photosensitive drum 1 is uniformly charged again by the corona charger 17*a*. Thereafter, the photosensitive drum is illuminated by a light beam L corresponding to a magenta component to form an electrostatic latent image thereon. The electrostatic latent image is visualized by the color developing device 8M as a magenta visible image. Then, the magenta visible image is superimposed on the yellow visible image transferred to the recording sheet P by repeatedly bringing the transfer rotary member 107 to the transfer station T.

Similarly, a cyan toner image and a black toner image are sequentially formed on the photosensitive drum 1 by the development by means of the developing devices 8C and B. These cyan and black toner images are sequentially superimposed on the superimposed images on the recording sheet P. Thereafter, the recording sheet P is separated from the transfer rotary member 107 by a separating means and is then sent to a fixing device 110, where the yellow, magenta, cyan and black toner images transferred to the recording sheet P are permanently fixed to the recording sheet with heat and pressure. Then, the recording sheet P is ejected onto an ejection tray 111.

Incidentally, in the illustrated embodiment, while an example that the full-color image is formed by four colors, i.e., yellow, magenta, cyan and black was explained, the present invention is not limited to this example, but, the full-color image may be formed by three colors such as yellow, magenta and cyan.

In the above-mentioned embodiment, the photosensitive drum 1, corona charger 17*a*, developing devices 8Y, 8M, 8C and cleaning device 18 are incorporated into a single container 20 to form the process cartridge C, which can be removably mounted within the image forming system 100. Further, independent of the process cartridge C, the black developing device can also be removably mounted within the image forming system 100. Thus, it is possible to cope with the difference in the frequency of use between the yellow, magenta and cyan color toners and the black toner. That is to say, if it is desired to mainly obtain the color image, when the yellow, magenta or toner is used up or the cleaning device 18 is completely filled with toner, the cartridge C may be exchanged. For example, if the frequency in use of the black toner is low, since the black toner still remains in the developing device B, then there is no need for exchanging this black developing device B, and the this developing device can be used continuously.

Further, in the illustrated embodiment, even when the consumption amounts of the yellow, magenta and cyan toners are different, the system can cope with it effectively. That is to say, in the embodiment shown in FIG. 1, second portions 19Y, 19M, 19C having toner containing portions 10Y, 10M, 10C, respectively can be removably mounted within the cartridge independently.

Incidentally, when an image mainly including characters which has less color portion is printed, the frequency in use of the black developing device B is increased, with the result that the black toner is used up in a relatively short time. Also in this case, only the black developing device B can be exchanged while mounting the cartridge as it is.

According to the embodiment shown in FIG. 1, in the developing devices 8Y, 8M, 8C, a plurality of first portions 50Y, 50M, 50C having developing rollers 4Y, 4M, 4C act as developer bearing members, and a plurality of second portions 19Y, 19M, 19C having developer containing members 10Y, 10M, 10C are detachable from each other. The second portions are detachable from the cartridge. In this case, after the second portions are mounted on the cartridge C, the latter is mounted within the image forming system 100. Incidentally, the mounting and dismounting of the second portions with respect to the cartridge C may be performed while maintaining the cartridge within the image forming system.

Figure 7:
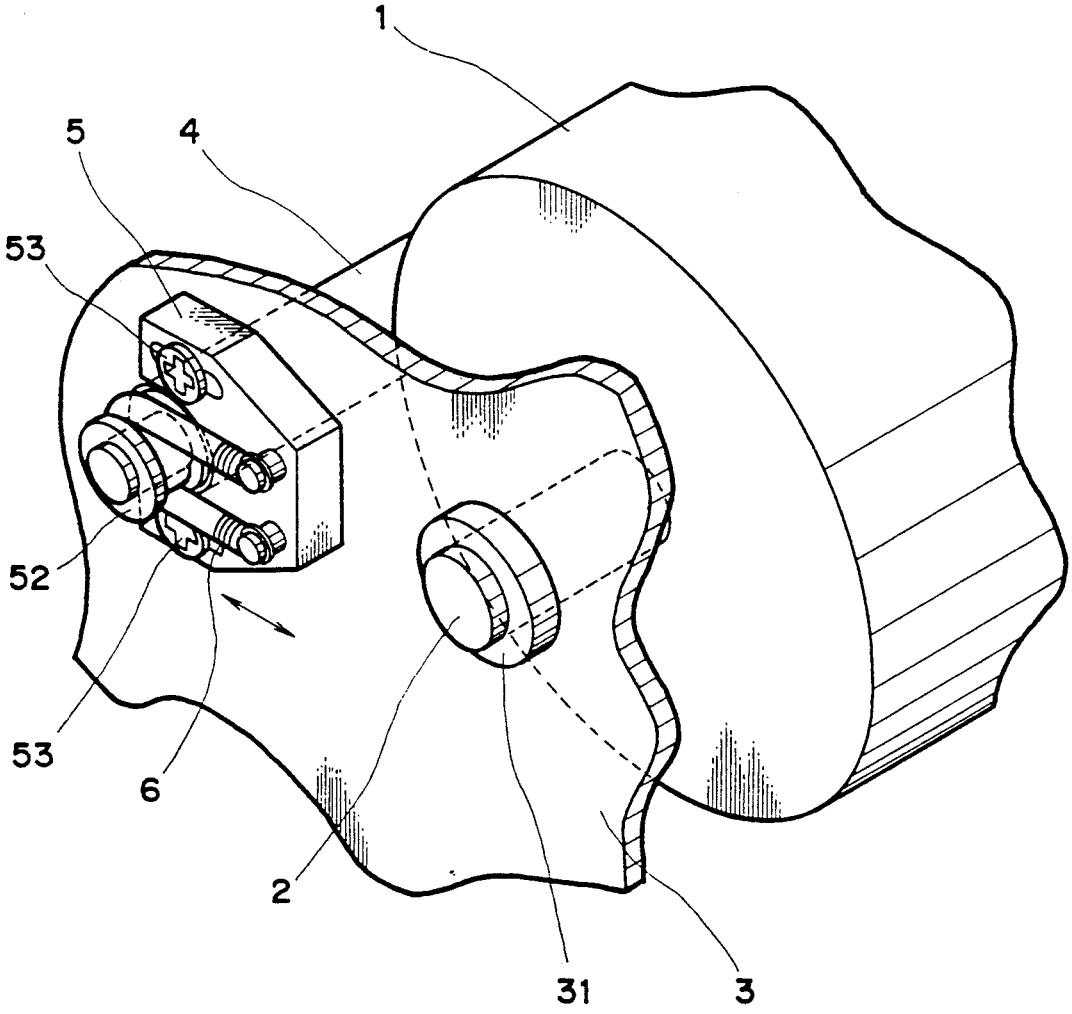
FIG. 7 is a perspective view showing a fixed position of the developing roller of FIG. 1 and therearound.

Further, as shown in FIGS. 1 and 7, the developing rollers 4Y, 4M, 4C are rotatably mounted on the side walls 3 via abutment members 5Y, 5M, 5C. The abutment members 5Y, 5M, 5C are made of resin or metallic bearing material, and areas of the abutment members by which the developing rollers 4Y, 4M, 4C are supported are coated with PTFE and the like, if necessary to increase the lubricity.

The abutment members 5Y, 5M, 5C are shiftably supported along an axis of the photosensitive drum 1 so that clearance between the photosensitive drum 1 and the developing rollers 4Y, 4M, 4C, rotatably mounted by the abutment members, can be adjusted by shifting these abutment members. After such clearances are adjusted to have a predetermined value, the abutment members 5Y, 5M, 5C are fixed to the side walls 3 by means of setscrews 53. The developing rollers 4Y, 4M, 4C are biased toward and urged against the respective abutment members 5Y, 5M, 5C by springs 6 with no play in the direction of the drum shaft 2.

Figure 2:
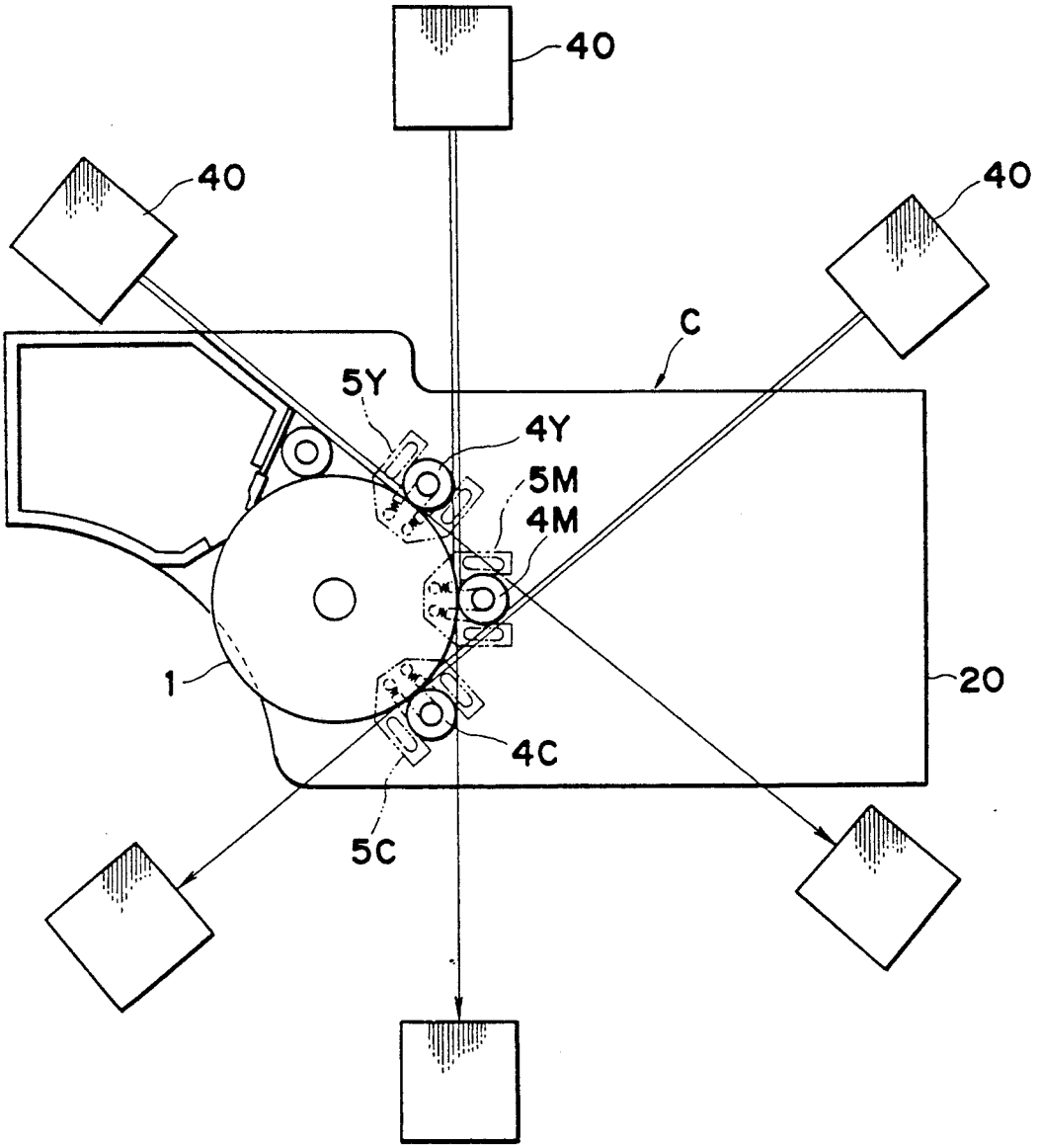
FIG. 2 is an elevational view showing means for adjusting clearance between a photosensitive drum and a developing roller in the process cartridge of FIG. 1.
Figure 3:
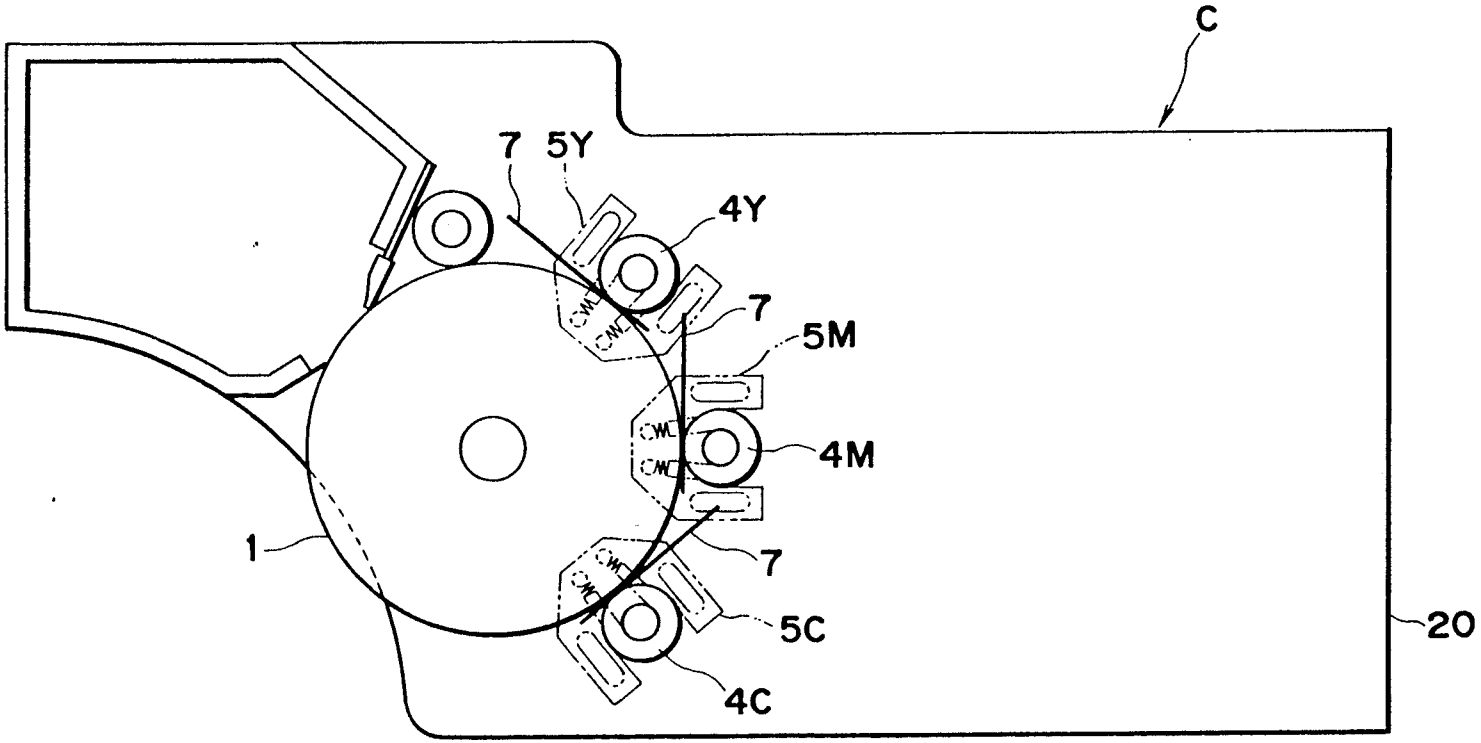
FIG. 3 is an elevational view showing another means for adjusting clearance between a photosensitive drum and a developing roller in the process cartridge of FIG. 1.

The adjustment of the clearances between the photosensitive drum 1 and the developing rollers 4Y, 4M, 4C are effected, for example as shown in FIGS. 2 and 3, by a method wherein the clearances between the developing rollers 4Y, 4M, 4C and the photosensitive drum 1 (i.e., the closest distances therebetween) are read by optical sensors 40 while attaching the developing rollers 4Y, 4M, 4C to the cartridge housing 20 and the positions of the abutment members 5Y, 5M, 5C are adjusted accordingly and then the abutment members 5Y, 5M, 5C are fixed. Another method for adjusting clearances is wherein spacers 7 having a predetermined thickness are interposed between the photosensitive drum 1 and the respective developing rollers 4Y, 4M, 4C and the positions of the abutment members 5Y, 5M, 5C are adjusted so that the removing forces for the spacers become a predetermined value, and then the abutment members 5Y, 5M, 5C are fixed.

On the other hand, the second portions 19Y, 19M, 19C other than the developing rollers 4Y, 4M, 4C are detachable with respect to the cartridge housing 20 by adopting the structure that will be described later. Further, such second portions include the developing portions 9Y, 9M, 9C and the toner containers 10Y, 10M, 10C, respectively. The toner containers are provided with openings 12Y, 12M, 12C and regulating members 51Y, 51M, 51C for regulating a thickness of the toner layers on the respective developing rollers at a side of the developer bearing members. Further, yellow toner 13Y, magenta toner 13M and cyan toner 13C are contained in the toner containers 10Y, 10M, 10C respectively. At the assembling of the color cartridge C, the toners 13Y, 13M, 13C are sealed with respect to the respective developing portions 9Y, 9M, 9C by seal film members 11Y, 11M, 11C.

After the adjustment of the clearances between the photosensitive drum 1 and the developing rollers 4Y, 4M, 4C is finished, the second portions 19Y, 19M, 19C are mounted on the cartridge housing 20. In this case, the regulating members are positioned to be abutted against the corresponding developing rollers or to be spaced apart from the developing rollers by a predetermined distance, and then, the second portions are fixed or secured to the housing 20 by fixing members 54Y, 54M, 54C. This condition will be referred to as "mounting position" hereinafter. In this way, the developing rollers 4Y, 4M, 4C are incorporated in the second portions 19Y, 19M, 19C through the openings 12Y, 12M, 12C, thus assembling the developing devices 8Y, 8M, 8C. In this case, after second portions 19Y, 19M, 19C are incorporated in the cartridge housing 20, these portions can be brought to the operative condition by removing the seal film members 11Y, 11M, 11C.

According to the above-mentioned method, only the developing device 8Y, 8M or 8C that the toner therein is used up can be exchanged, and the positional relation between the photosensitive drum 1 and the developing rollers 4Y, 4M, 4C is previously adjusted Accordingly, since the re-adjustment of such positional relation is not required whenever the developing device is exchanged, it is possible to use the toners remaining in the other developing devices economically and to obtain the good image output stably. Further, according to the above-mentioned method, it is also possible to replace a developing device having a low frequency of use in a developing device having a high frequency of use.

Furthermore, there can be obtained an advantage that the moisture is hard to enter into the containers in comparison with the case where the toner is replenished in the container. Incidentally, toner sensors 8Y1, 8M1, 8C1, 8B1 are provided to detect the toner conditions in the respective developing devices 8Y, 8M, 8C, 8B. Signals from the toner sensors are sent to a control portion 200 (described later) to provide the toner empty display.

Figure 4:
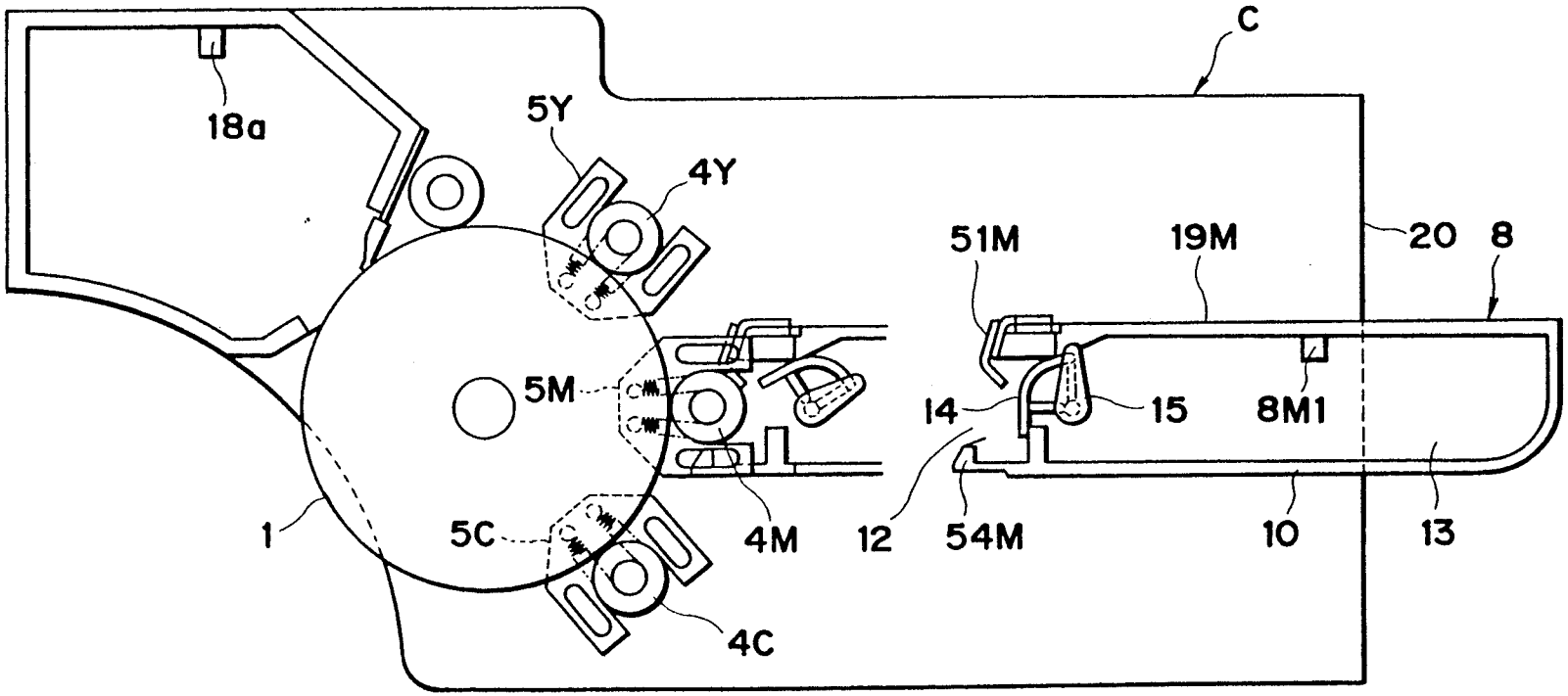
FIG. 4 is an elevational sectional view of a process cartridge according to a second embodiment of the present invention.

Next, a second embodiment of the present invention is shown in FIG. 4. Incidentally, the same elements having the same function as those shown in FIG. 1 are designated by the same reference numerals.

In the second embodiment shown in FIG. 4, in place of the seal film members 11, the developing devices 8 are provided with openable lids 14. Each lid or seal member 14 is biased by a corresponding spring (not shown) toward a closed position to prevent flow out the toner in the toner container 10 toward the developing portion 9. When the color cartridge C is inserted into the image forming system, a cam 15, provided at one end of the lid 14, is pushed to open the lid 14. When the toner 13 in the container 10 is used up and the cartridge C is dismounted from the image forming system, the opening 12 of the developing device 8 is closed again by the lid 14.

With this arrangement, it is possible to prevent the scattering of the toner of a little amount remaining in the empty container 10 during the exchange of the developing devices and to prevent an operator from being smeared with toner.

Alternatively, when the second portion 19M is mounted on the cartridge 20 at its mounting position, the seal member or lid 14 may be opened to release the opening 12, and, when the second portion is shifted to a position different from the mounting position (i.e., to a position where the regulating member 51M is separated from the developing roller 4M by a predetermined distance or more), the opening 12 may be automatically closed by the seal member 14. The seal member or lid may be made of elastic material such as a polyethylene film or rigid material such as a metal sheet or a plastic sheet. Incidentally, the other two developing devices 4Y, 5Y and 4C, 5C have the same construction.

Figure 5:
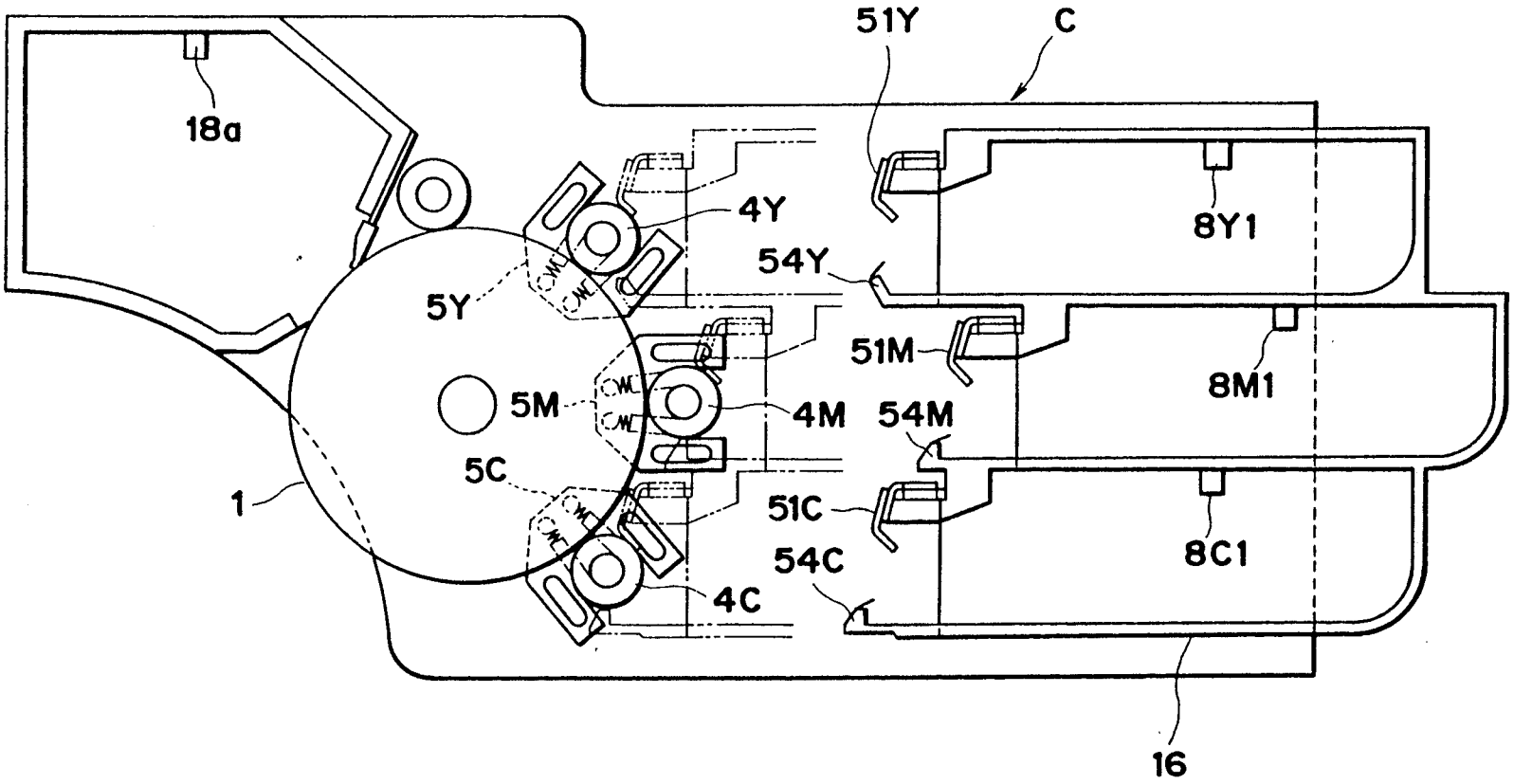
FIG. 5 is an elevational sectional view of a process cartridge according to a third embodiment of the present invention.

Next, a third embodiment of the present invention will be explained with reference to FIG. 5.

In this third embodiment, the second portions are integrally molded as a unit 16. The other arrangements are the same as those of the first embodiment.

With this arrangement, when the service lives of the constructural parts of the second portions 16 (for example, regulating members or blades 51Y, 51M, 51C for regulating the thickness of the toner layers) are expired, the second portions 16 can be exchanged at a time, thus improving the operability.

Figure 6:
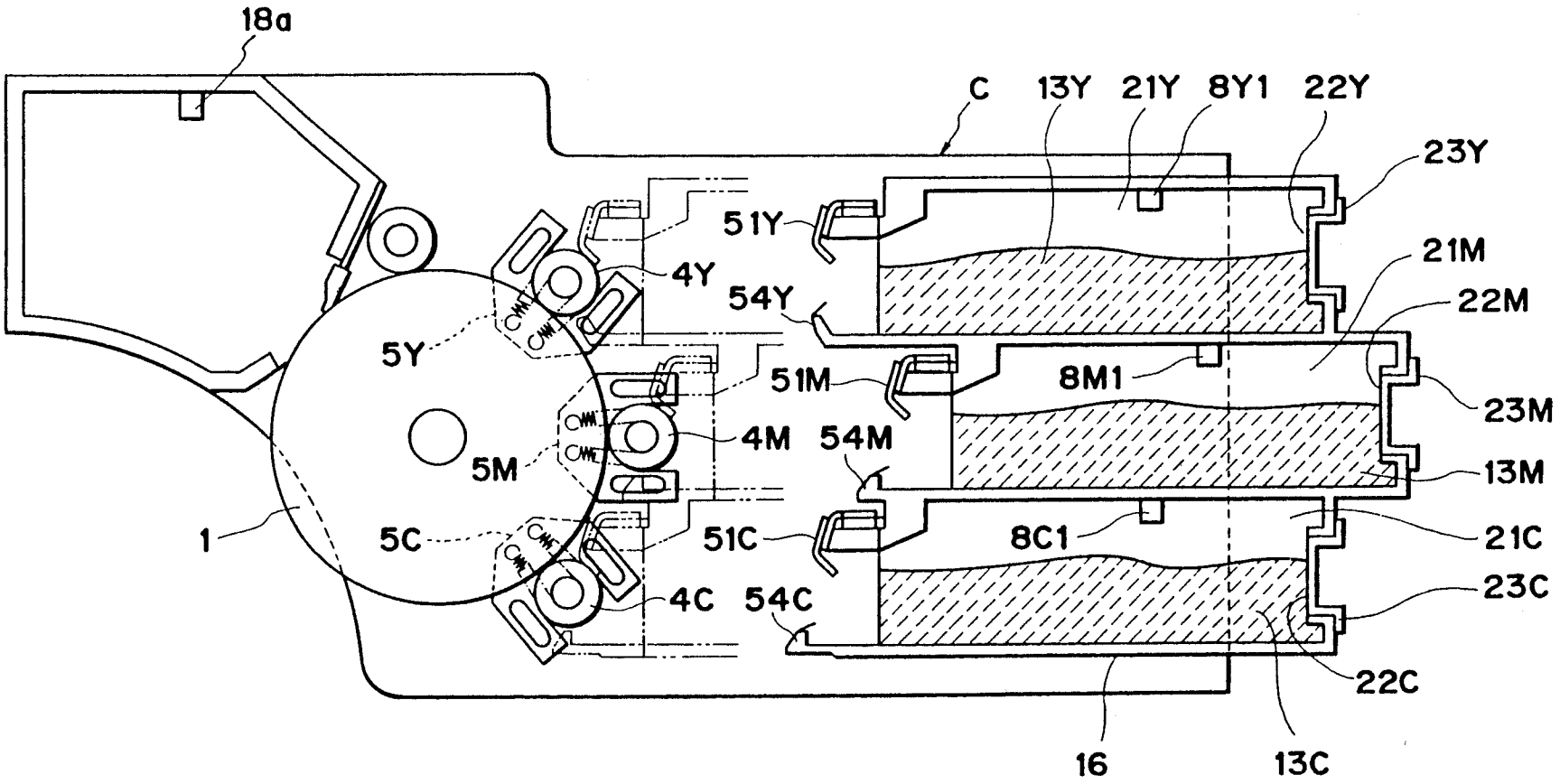
FIG. 6 is an elevational sectional view of a process cartridge according to a fourth embodiment of the present invention.

Next, a fourth embodiment of the present invention is shown in FIG. 6.

In the fourth embodiment shown in FIG. 6, the second portions are formed integrally as a unit 16, and each of toner containers 21Y, 21M, 21C has a loading opening 22Y, 22M, 22C for loading color toners 13Y, 13M, 13C, and a cap 23Y, 23M, 23C for closing the respective opening, respectively. When the toner in any container is used up, the unit 20 is dismounted from the cartridge housing 20 and new toner is replenished through the loading opening.

According to this embodiment, the replenishment of toner in the toner container can easily be effected. Incidentally, it should be noted that the above-mentioned loading openings and caps may be provided in the above first and second embodiments wherein the second portions are not integrally formed. Further, when the cap is connected or chained to the toner container, it is not feared that the cap is missing.

Now, the detection of the residual amount of toner in the above first and second embodiment will be explained with reference to a flow chart of FIG. 10. Incidentally, an example that the detection of the waste toner full condition in the cleaner 18 and the detection of the residual amount of toner in the black developing unit B formed independently from the cartridge C are effected simultaneously.

First of all, it is judged whether the cleaning device 18 in the cartridge is completely filled with the waste toner (STEP 1) on the basis of a detection signal from a waste toner full detection means 18*a*. If affirmative (i.e., "full"), the display for indicating the necessity of exchange of the cartridge C is effected (STEP 2). On the other hand, if negative in the STEP 1, it is judged whether the yellow developing device 8Y is empty (STEP 3) on the basis of a detection signal from a first residual amount detection means 8Y1. If empty, the display for indicating the necessity of exchange of the second portion 19Y is effected (STEP 4). On the other hand, if not empty, it is judged whether the magenta developing device 8M is empty (STEP 5) on the basis of a detection signal from a second residual amount detection means 8M1. If empty, the display for indicating the necessity of exchange of the second portion 19M is effected (STEP 6). On the other hand, if not empty, it is judged whether the cyan developing device 8C is empty (STEP 7) on the basis of a detection signal from a third residual amount detection means 8C1. If empty, the display for indicating the necessity of exchange of the second portion 19C is effected (STEP 8). On the other hand, if not empty, it is judged whether the black developing unit B is empty (STEP 9) on the basis of a detection signal from a fourth residual amount detection means 8B1. If empty, the display for indicating the necessity of exchange of the black developing unit B is effected (STEP 10). On the other hand, if not empty, the printing operation is continued.

Incidentally, in the third and fourth embodiments, it may be so controlled that, when either color toner 13Y, 13M or 13C is used up, the display for indicating the necessity of exchange of the integral unit 16 is effected. Further, regarding the black developing unit, similar to the other developing devices, only a second portion other than the developing roller may be exchanged.

Next, a function block diagram regarding the above-mentioned embodiments will be briefly explained with reference to FIG. 11.

Figure 10:
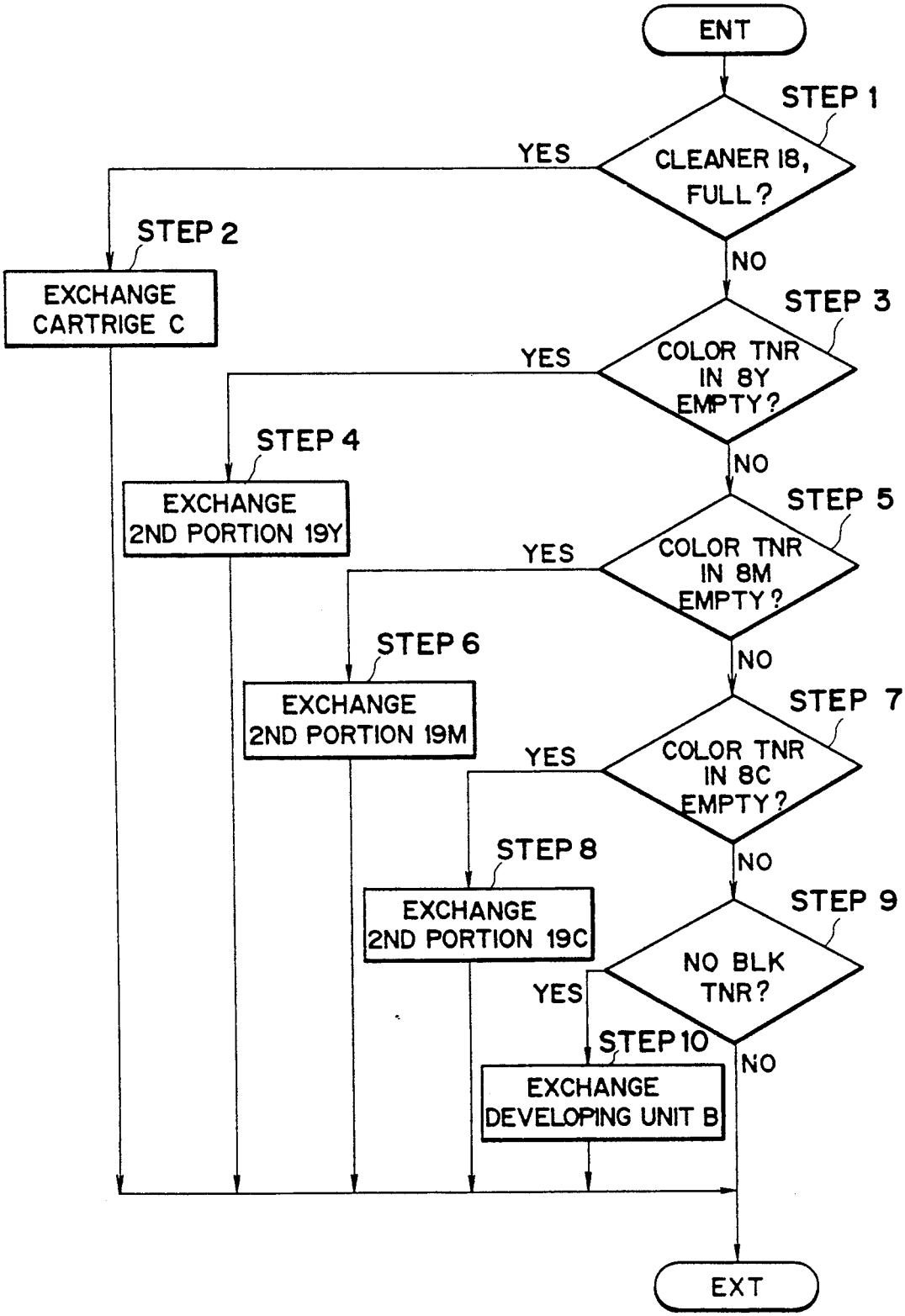
FIG. 10 is a flow chart for performing the exchange of a cleaner, cartridge and developing unit, according to the present invention.
Figure 11:
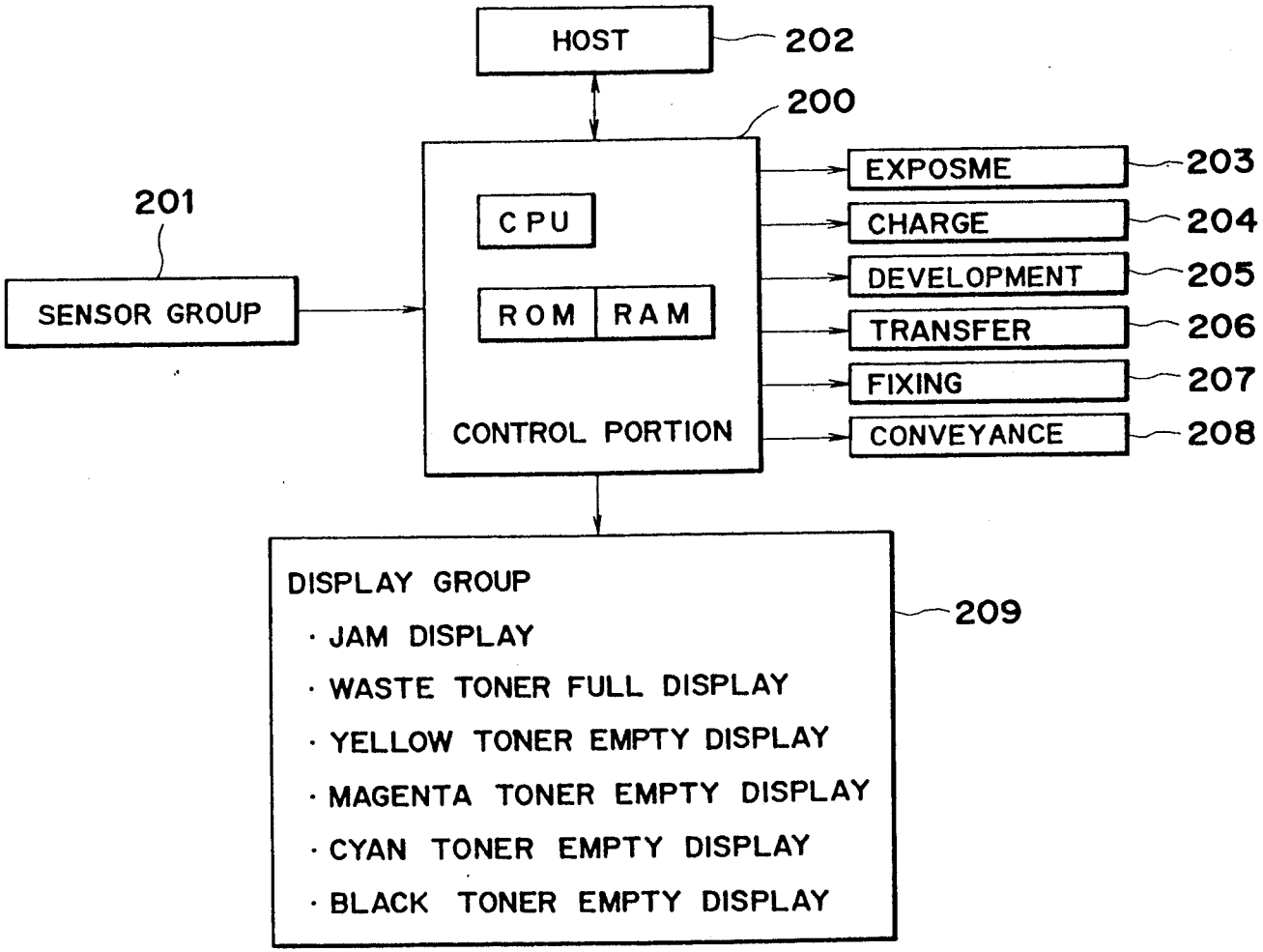
FIG. 11 is a control block diagram of the image forming system to which the present invention is applied.

In FIG. 11, a control portion 200 serves to control the whole image forming system and includes a CPU such as a microcomputer, a ROM for storing the CPU controlling program such as shown in the flow chart of FIG. 10 and various data, and a RAM used as a work area for the CPU and adapted to temporality store the various data.

The control portion 200 receives from signals from a sensor group 201 comprising a sheet jam sensor (jam sensor), waste toner full detection sensor 18*a*, yellow toner "empty" sensor 8Y1, magenta toner "empty" sensor 8M1, cyan toner "empty" sensor 8C1 and black toner "empty" sensor 8B1. On the other hand, a variety of information such as image information and the like from a host 202 such as a computer, word processor and the like are also sent to the control portion 200. On the basis of this information, the control portion 200 controls the above-mentioned various processes such as exposure 203, charge 204, development 205, transfer 206 and fixing 207, and conveyance 208 for the recording sheet. Further, the control portion 200 controls a display group 209 to effect the jam display, waste toner full display, yellow toner empty display, magenta toner empty display, cyan toner empty display and black toner empty display.

In the above-mentioned embodiments, while the full-color image forming system and the process cartridge mountable thereon were explained, the present invention may be applied to a process cartridge having a single developing device.

As mentioned above, according to the present invention, since the process cartridge has a first portions including developer bearing members and second portions including toner containing members which can be separated from each other, with the second portions being detachable with respect to the cartridge, the cartridge constituting elements can be utilized effectively. Further, when the toner is replenished, since only the second portions can be dismounted from the cartridge while remaining the first portions in the cartridge, the positioning of the developer bearing members with respect to the image bearing member and such positioning is not required to be effected repeatedly.

The present invention is not limited to the above-mentioned embodiments, but, various alterations and modifications can be effected within the scope of the present invention.

What is claimed is:

1. A process cartridge which can be removably mounted within an image forming system, comprising:

an image bearing member; and developing means adapted to develop a latent image formed on said image bearing member and having a developer bearing member and a containing member for containing developer; wherein said developing means can be separated into a first portion comprising said developer bearing member and a second portion comprising said containing member, wherein said second portion can be removably mounted on said process cartridge, and said second portion has a regulating member for regulating a thickness of the developer on said developer bearing member.

2. A prosess cartridge according to claim 1, further comprising charger means for charging said image bearing member, and cleaning means for removing residual matters remaining on said image bearing member.

3. A process cartridge according to claim 1, further comprising a plurality of additional developing means for performing the development with colors different from that of the first-mentioned developing means, wherein each of said plurality of additional developing means can be separated into a first portion including a developer bearing member and a second portion including a containing member, and said second portion of each additional developing means can be removably mounted on said process cartridge.

4. A process cartridge according to claim 3, wherein said containing members of said additional developing means include developer with various colors.

5. A process cartridge according to claim 4, wherein said colors of said developer are yellow, magenta and cyan.

6. A process cartridge according to claim 3, wherein said second portions of said additional developing means are formed integrally with each other.

7. A process cartridge according to claim 1, wherein said second portion has a detection means for detecting the presence/absence of the developer in said containing means.

8. A process cartridge according to claim 1, wherein said second portion provides an opening at a side of said developer bearing member when said second portion is mounted on said process cartridge at its mounting position.

9. A process cartridge according to claim 8, further comprising a seal member automatically closing said opening when said second portion is shifted to a position other than said mounting position.

10. An image forming system, comprising:

a mounting portion capable of removably mounting a process cartridge within said image forming system;

said process cartridge comprising an image bearing member, and developing means adapted to develop a latent image formed on said image bearing member and having a developer bearing member and a containing member for containing developer, wherein said developer means can be separated into a first portion comprising said developer bearing member and a second portion comprising said containing member, wherein said second portion can be removably mounted on said process cartridge, and said second portion has a regulating member for regulating a thickness of the developer on said developer bearing member.

11. An image forming system according to claim 10, further comprising charger means for charging said image bearing member, and cleaning means for removing residual matters remaining on said image bearing member.

12. An image forming system according to claim 10, further comprising a plurality of additional developing means for performing the development with colors different from that of the first-mentioned developing means, wherein each of said plurality of additional developing means can be separated into a first portion including a developer bearing member and a second portion including a containing member, and said second portion of each additional developing means can be removably mounted on said process cartridge.

13. An image forming system according to claim 12, wherein said containing members of said additional developing means include developer with various colors, and said image forming system forms an image on a single recording sheet by superimposing developed color images corresponding said colors.

14. An image forming system according to claim 13, wherein said colors of said developer are yellow, magenta and cyan.

15. An image forming system according to claim 12, wherein said second portions of said additional developing means are formed integrally with each other.

16. An image forming system according to claim 10, wherein said second portion has measuring means for measuring a residual amount of the developer in said containing means.

17. An image forming system according to claim 10, wherein said second portion has detection means for detecting the presence/absence of the developer in said containing means.

18. An image forming system according to claim 10, wherein said second portion provides an opening at a side of said developer bearing member when said second portion is mounted on said process cartridge at its mounting position.

19. An image forming system according to claim 18, further comprising a seal member automatically closing said opening when said second portion is shifted to a position other than said mounting position.

20. A process cartridge attachable to and detachable from an image forming apparatus, said process cartridge comprising:

an image bearing member; and a plurality of developing means for developing a latent image formed on said image bearing member, each of said plural developing means comprising a developing agent bearing member and a developing agent supplementing container attachable directly to and separatable from said developing agent bearing member, wherein each of said plural developing agent supplementing containers is attachable to and detachable from said process cartridge independently.

21. A process cartridge according to claim 20, further comprising a frame containing said image bearing member and said plural developing means, in which said plural developing agent supplementing container is contained.

22. A process cartridge according to claim 20, wherein each of said plural developing agent supplementing containers has a developing agent of a different color.

23. A process cartridge according to claim 22, wherein the plural developing agents are yellow, magenta and cyan.

24. A process cartridge according to claim 20, wherein each of said plural developing agent supplementing containers has an opening for supplying the developing agent to said developing agent bearing member, and a shiftable cover member for covering said opening.

25. A process cartridge according to claim 24, wherein said cover member opens said opening when said developing agent supplementing container is mounted in a predetermined position on said process cartridge, and closes said opening when it retracts from the predetermined position.

26. A process cartridge according to claim 20, further comprising charger means for charging said image bearing member, and cleaning means for cleaning residual matter remaining on said image bearing member.

27. A process cartridge according to claim 20, wherein said developing agent bearing member has a roller.

28. An image forming apparatus to which a process cartridge is attachable and from which said process cartridge is detachable, said image forming apparatus comprising:

a mounting portion for mounting said process cartridge, which comprises an image bearing member, a plurality of developing means for developing a latent image formed on said image bearing member, each of said plural developing means comprising a developing agent bearing member and a developing agent supplementing device attachable directly to and separatable from said developing agent bearing member;

wherein each of said plural developing agent supplementing devices can be attached to and detached from said process cartridge independently.

29. A process cartridge according to claim 28, further comprising another developing means separated from said process cartridge.

30. A process cartridge according to claim 29, wherein the developing agent in said another developing means is of black color.

31. A process cartridge according to claim 29, wherein said another developing means is attachable to or detachable from said image forming apparatus.

32. A process cartridge according to claim 28, wherein said plural supplementing devices have developing agents of different colors, and said image forming apparatus forms the image by superimposing different colors of inks onto the same recording material sequentially.

* * * * *

UNITED STATES PATENT AND TRADEMARK OFFICE

CERTIFICATE OF CORRECTION

PATENT NO. : 5,249,026

DATED : September 28, 1993

INVENTOR(S) : Hisayoshi Kojima

It is certified that error appears in the above-indentified patent and that said Letters Patent is hereby corrected as shown below:

Title page,
AT [56] References Cited - at OTHER PUBLICATIONS:
"japan" should read --Japan--.

IN THE DRAWINGS - FIGURE 10:
"CARTRIGE c" should read --CARTRIDGE C--; and

IN THE DRAWINGS - FIGURE 11:
"EXPOSME" should read --EXPOSURE--.

COLUMN 1:
line 34, "been" should be deleted;
line 51, "developing" should read --the developing--.

COLUMN 2:
line 56, "the C" should read --the cartridge C--.

COLUMN 3:
line 18, "jamping" should read --Jumping--;
line 43, "Myler" should read --Mylar--;
line 45, "rotary" should read --the rotary--;
line 46, "In, in" should read --In--; and
line 60, "an" should read --a--.

COLUMN 4:
line 39, "or toner" should read --or cyan toner--;
line 45, "the this" should read --this--; and
line 52, "respectively" should read --respectively,--.

UNITED STATES PATENT AND TRADEMARK OFFICE

CERTIFICATE OF CORRECTION

PATENT NO. : 5,249,026

DATED : September 28, 1993

INVENTOR(S) : Hisayoshi Kojima

It is certified that error appears in the above-indentified patent and that said Letters Patent is hereby corrected as shown below:

COLUMN 6:

line 17, "adjusted" should read --adjusted.--;
line 24, "in" should read --and--;
line 42, "out the" should be deleted; and
line 43, "toner in the toner container" should read --toner from flowing out of the toner container--.

COLUMN 7:

line 7, "constructural" should read --constructional--; and
line 20, "unit 20" should read --unit 16--.

COLUMN 8:

line 16, "temporality" should read --temporarily--;
line 42, "a" should be deleted;
line 50, "while remaining the first portions in the cartridge" should read --while allowing the first portions to remain in the cartridge"; and
line 55, "but," should read --and--.

COLUMN 9:

line 7, "prosess" should read --process--;
line 9, "matters" should read --matter--;
line 17, close upright margin;
line 53, "developer" should read --developing--; and
line 64, "matters" should read --matter--.

UNITED STATES PATENT AND TRADEMARK OFFICE

CERTIFICATE OF CORRECTION

PATENT NO. : 5,249,026

DATED : September 28, 1993

INVENTOR(S) : Hisayoshi Kojima

It is certified that error appears in the above-indentified patent and that said Letters Patent is hereby corrected as shown below:

COLUMN 10:
line 15, "corresponding" should read --corresponding to--.

Signed and Sealed this

Nineteenth Day of July, 1994

Bruce Lehman

BRUCE LEHMAN

*Commissioner of Patents and Trademarks*

*Attest:*

*Attesting Officer*